US006932005B2

(12) United States Patent
Tajima

(10) Patent No.: US 6,932,005 B2
(45) Date of Patent: Aug. 23, 2005

(54) FRAME MOVEMENT COMMAND DEVICES FOR EMBROIDERY MACHINE

(75) Inventor: Ikuo Tajima, Aichi-ken (JP)

(73) Assignee: Tokai Kogyo Mishin Kabushiki Kaisha, Kasugai (JP)

( * ) Notice: Subject to any disclaimer, the term of this patent is extended or adjusted under 35 U.S.C. 154(b) by 96 days.

(21) Appl. No.: 10/275,950

(22) PCT Filed: May 11, 2001

(86) PCT No.: PCT/JP01/03970

§ 371 (c)(1),
(2), (4) Date: Nov. 15, 2002

(87) PCT Pub. No.: WO01/88248

PCT Pub. Date: Nov. 22, 2001

(65) Prior Publication Data

US 2003/0159635 A1 Aug. 28, 2003

(30) Foreign Application Priority Data

May 15, 2000 (JP) ..... 2000-142373

(51) Int. Cl.[7] ..... D05C 5/02
(52) U.S. Cl. ..... 112/102.5; 112/470.04
(58) Field of Search ..... 112/102.5, 470.04, 112/470.05, 470.06; 200/553, 557; 348/110; 700/138

(56) References Cited

U.S. PATENT DOCUMENTS 4,403,559 A * 9/1983 Hirose ..... 112/470.04
4,506,300 A * 3/1985 Fearnside ..... 348/110
5,432,530 A 7/1995 Arita et al.

FOREIGN PATENT DOCUMENTS

| | | |
|---|---|---|
| JP | 64-32889 | 2/1989 |
| JP | 4-205214 | 7/1992 |
| JP | 6-18754 | 5/1994 |
| JP | 6-240557 | 8/1994 |
| JP | 10-323469 | 12/1998 |
| JP | 11-19367 | 1/1999 |

* cited by examiner

*Primary Examiner*—Peter Nerbun
(74) *Attorney, Agent, or Firm*—Dennison, Schultz, Dougherty & MacDonald

(57) ABSTRACT

In a frame movement command device for an embroidery machine, which device can control the movement of an embroidery frame based upon signals that are outputted from a frame drive means when a frame movement command switch is operated, the frame movement command switch includes a single operation portion that is operable to incline in a plurality of directions, and the frame drive means outputs signals in order to move the embroidery frame in directions that correspond to the inclined directions of the operation portion.

According to this construction, by inclining the single operation portion of the frame movement command switch in the plurality of directions, the embroidery frame can move in directions that correspond to the inclined directions. Therefore, the operator can accurately operate the switch in order to move the embroidery frame toward a desired position, which depends only on the feeling of his or her fingertips touching the operation portion without viewing the frame movement command switch. Therefore, the operator can move the embroidery frame in the intended direction while observing a point adjacent to the lower side of a sewing head.

5 Claims, 8 Drawing Sheets

FRAME MOVEMENT COMMAND DEVICES FOR EMBROIDERY MACHINE

This application is a 371 of PCT/JP01/03970, filed May 11, 2001.

TECHNICAL FIELD TO WHICH THE INVENTION BELONGS

This application relates to frame movement commanding devices in embroidery machines, which devices serve to control the movement of an embroidery frame by the operation of switches.

RELATED ART

Generally speaking, in embroidery machines (sewing machines), while a needle bar or similar part of a sewing head is not moving, the movement of an embroidery frame can be independently controlled by operating a command switch that is provided in an operation panel box in order to move the frame in a power turned-ON state. One of its objects is to position the embroidery frame before an embroidery operation is started. Such a positioning operation may be performed when an embroidery starting point of a cloth or the like, which has been set onto the embroidery frame, must be accurately aligned with a needle traveling direction of the sewing head.

FIG. 10 shows a front view of an example of an operation panel box 80 of a known embroidery machine. A frame movement command switch 82 is provided on the operation panel box 80 and includes a total of eight arrow keys 84, which are respectively labeled with arrows, and a speed change key 86 that is positioned in the center of the arrow keys 84. By selectively pressing the arrow keys 84, the embroidery frame can be controlled to move in any of the directions indicated by the arrows labeled on the respective arrow keys 84. The speed change key 86 serves as a switch for changing the moving speed of the embroidery frame, and this speed can be alternatively changed between "high speed" and "low speed" every time that the speed change key is pressed.

Therefore, when the speed is changed to "high speed" using the speed change key 86 and any one of the arrow keys 84 is pressed, the embroidery frame may move at a high speed in the direction indicated by the arrow. On the other hand, when the speed is changed to "low speed", the embroidery frame may move at a slower speed.

During the positioning of the embroidery frame before the embroidery operation is started as described above, the operator controls the movement of the embroidery frame by operating the frame movement command switch 82 while the operator closely observes the needle traveling direction of the sewing head and the embroidery starting point of the cloth or the like. However, this movement control requires a plurality of (eight) arrow keys 84 to be selectively pressed; therefore, it is possible that the arrow keys 84 may mistakenly be pressed while the operator is observing the area adjacent to and below the sewing head. As a result, it is difficult for the operator to move the embroidery frame in the direction intended by the operator.

In addition, although the operator may prefer to operate the switch with his or her face close to the front side of the sewing head, this may be hindered because the frame movement command switch 82 is provided on the operation panel box 80.

SUMMARY OF THE INVENTION

Accordingly, it is one object of the present invention to enable an operator to control the movement of an embroidery frame in the direction intended by the operation of a frame movement control switch, even while the operator is observing areas adjacent to and below the sewing head.

It is another object of the present invention to enable simultaneously control of the moving direction and the moving speed of the embroidery frame, thereby improving operability.

It is also an object of the present invention to eliminate the hindrance in terms of location so as to enable movement control of the embroidery frame to be performed at any location during the positioning of the embroidery frame by the operation of the switch before the embroidery operation is started.

According to the invention of claim 1, in a frame movement command device for an embroidery machine, which device can control the movement of an embroidery frame based upon signals that are outputted from a frame drive means when a frame movement command switch is operated, the frame movement command switch includes a single operation portion that is operable to incline in a plurality of directions, and the frame drive means outputs signals in order to move the embroidery frame in directions that correspond to the inclined directions of the operation portion.

Thus, by inclining the single operation portion of the frame movement command switch in the plurality of positions, the embroidery frame can move in the directions that correspond to the inclined directions. Therefore, depending only on the feeling of fingertips touching the operation portion and without watching the frame movement command switch, the operator can accurately operate the switch to correspond to the direction that is intended for the movement of the embroidery frame. Therefore, the operator can move the embroidery frame in the intended direction while observing areas adjacent to and below a sewing head.

According to the invention claim 1, the frame movement command switch is disposed in an operation panel box of the embroidery machine, and a surface of the operating portion is set to be flush with or slightly concave relative to a front surface of the operation panel box.

Therefore, the operation portion of the frame movement command switch may be positively prevented from being mistakenly operated.

The inventions relate to embodiments of the operation portion of the frame movement command switch. The operation portion is constituted by fixing an operation disk onto a tip end of an operation rod that extends from inside of a switch body. Arrows indicative of the operating directions of the operation portion are provided on a surface of the operation disk.

According to the invention as in claim 1, the operation portion of the frame movement command switch can be operated so as to be inclined in any direction from an original position.

Therefore, the embroidery frame can be moved in any intended direction by operating the operation portion.

According to the invention of claim 2 as in claim 1, the frame drive means outputs signals to increase and decrease the moving speed of the embroidery frame in response to the inclination angle of the operation portion of the frame movement command switch relative to the original position.

Therefore, the moving direction and the moving speed of the embroidery frame can be simultaneously controlled by inclining the operation portion of the frame movement command switch, thereby improving operability. In addition, a dedicated switch, which is provided only for changing the moving speed of the embroidery frame, is no longer required.

According to the invention of claim 1, the frame movement command switch is connected to the operation panel box of the embroidery machine via any one of a cord, radio waves or light, and the frame movement command switch is disposed within a portable switch case.

Therefore, the hindrance in location may be eliminated during the positioning of the embroidery frame by operating the switch before the embroidering operation is started. For example, the operator may carry the switch case and may move to a position adjacent the front side of the sewing head, so that the operator can operate the switch while he or she is located in this position.

According to the invention of claim 3, the switch case includes a grip portion and is configured to permit fingertips to easily touch the operation portion of the frame movement command switch while the operator holds the grip portion.

Each of the operation panel box and the portable switch case is provided with frame movement command switches.

In this case, the operator can selectively utilize the most convenient of either the frame movement command switch of the operation panel box or the frame movement command switch of the switch case.

Additional features, aspects and advantages of the present invention will become more fully apparent by reading the following description with reference to the drawings.

DESCRIPTION OF THE PREFERRED EMBODIMENTS

Embodiments of the present invention will now be described with reference to FIGS. 1 to 9.

Figure 1:
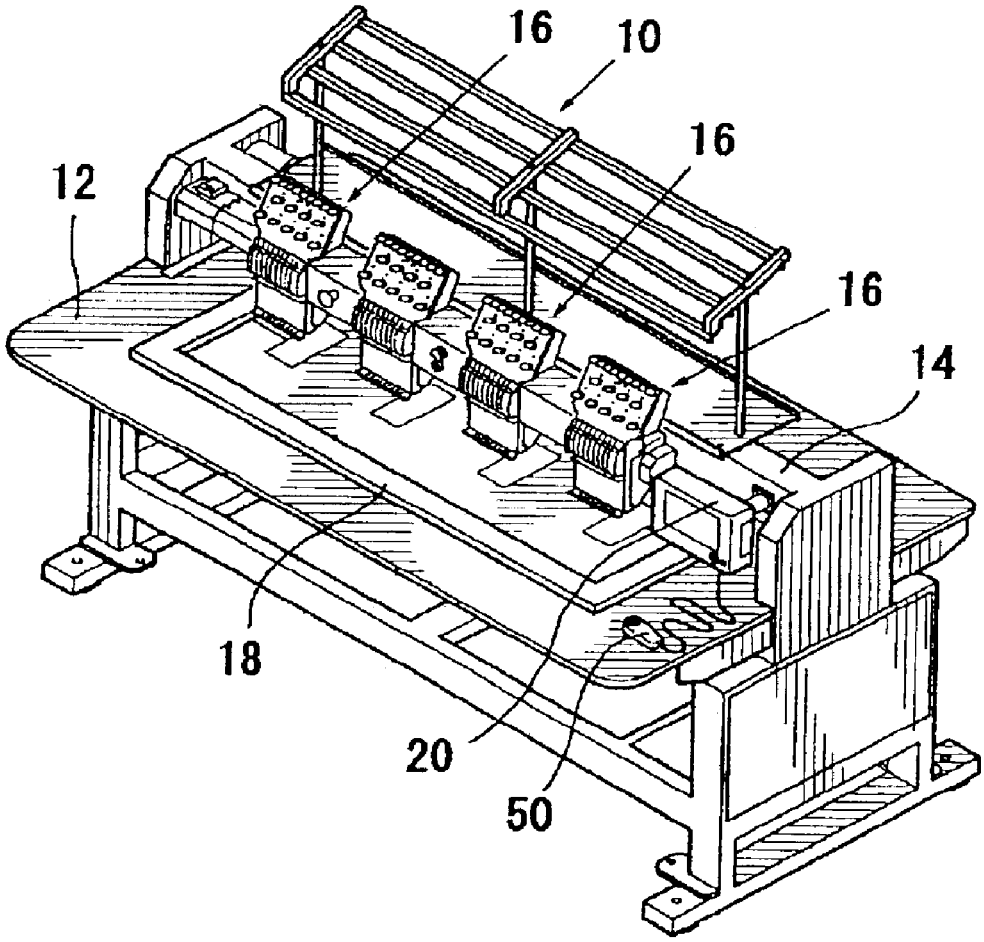
FIG. 1 is a perspective view of an embroidery machine (sewing machine).

FIG. 1 is a perspective view showing an embroidery machine (sewing machine). A frame 14 is disposed so as to extend in the right and left directions over a table 12 of the embroidery machine 10 shown in this figure. A plurality of (four) multi-needle type sewing heads 16 is mounted on the frame 14 in a single horizontal row, and an operation panel box 20 is mounted on the frame 14 at a right side portion of the embroidery machine 10. An embroidery frame 18 (whole cloth frame) is disposed on the upper surface of the table 12 and is moved within a plane defined by an X-axis and a Y-axis under control based on embroidery data in a known manner.

Figure 2:
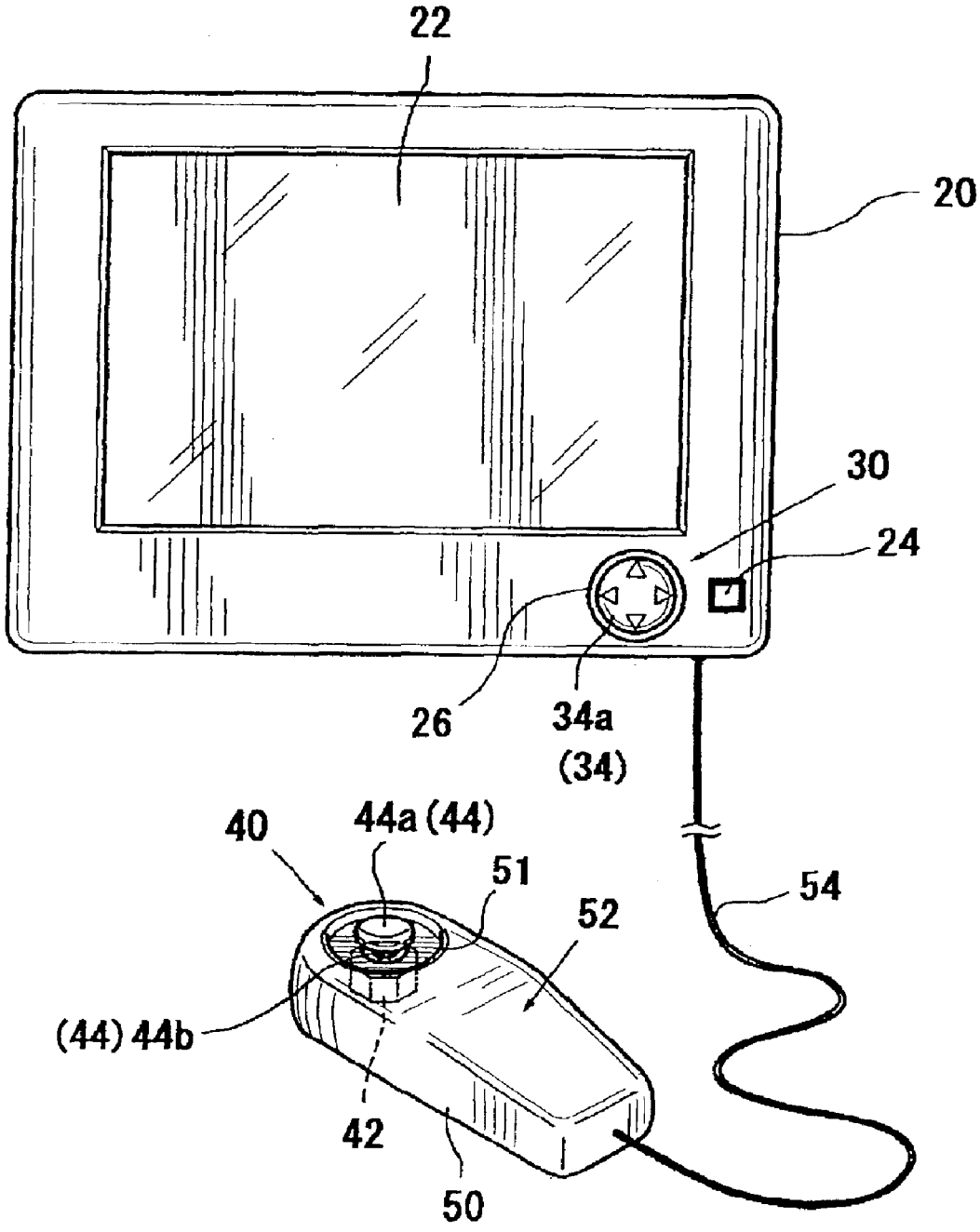
FIG. 2 is a structural view showing an operation panel box in an enlarged scale.
Figure 3:
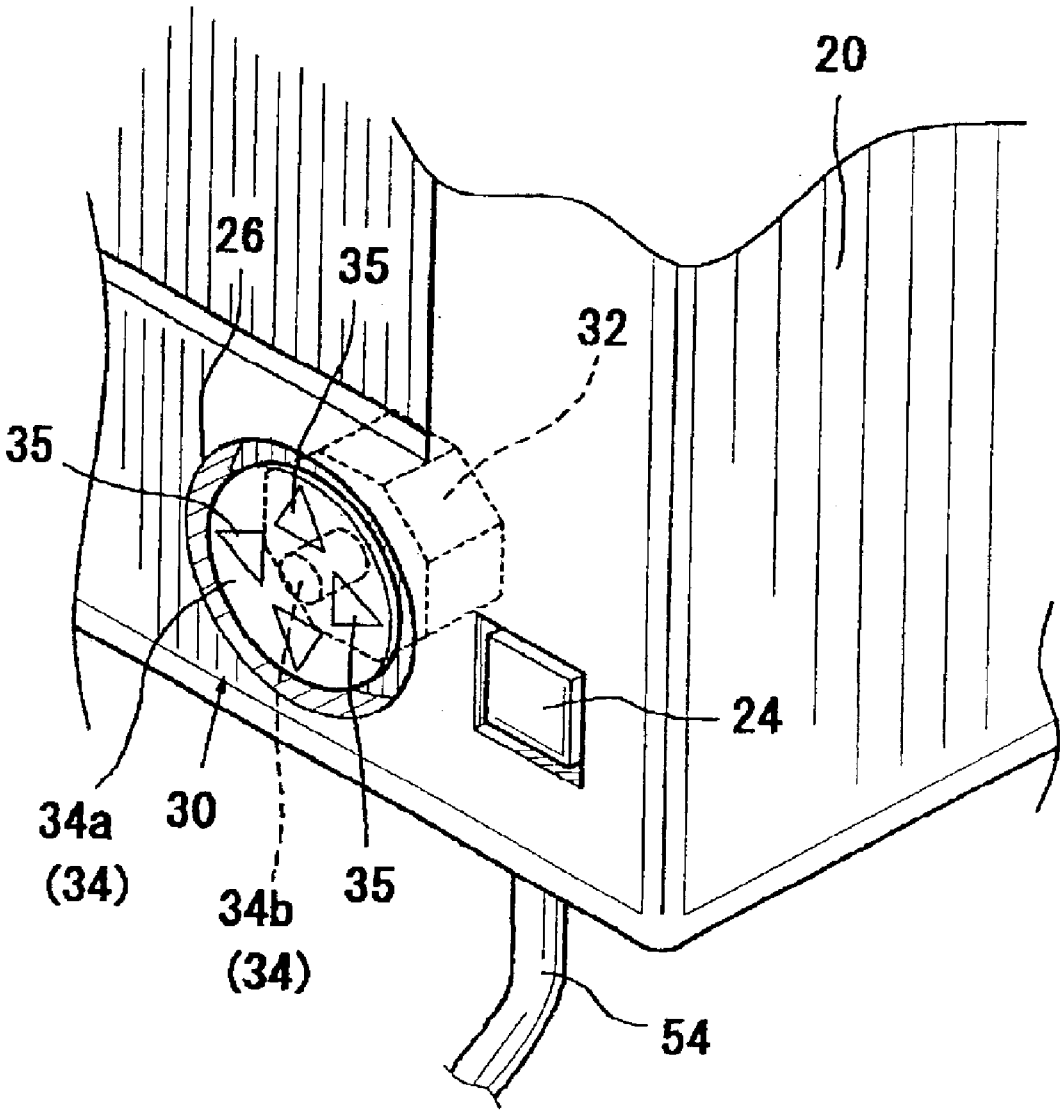
FIG. 3 is a perspective view showing a part of the operation panel box in a further enlarged scale.

FIG. 2 is a structural view showing the operation panel box 20 in an enlarged scale, and FIG. 3 is a perspective view showing a part of the operation panel box 20 in a further enlarged scale. A liquid crystal panel 22 having a touch switch sheet, a frame movement command switch 30 positioned on the lower right side of the liquid crystal panel 22, and a speed change switch 24 positioned adjacent to the right side of the frame movement command switch 30 are mounted on the front surface of the operation panel box 20. The frame movement command switch 30 is operable to control the movement of the embroidery frame 18. The speed change switch 24 is operable to alternatively change the moving speed of the embroidery frame 18 between "high speed" and "low speed," as described above. In addition, in this embodiment, a frame movement command switch 40 also is mounted within a portable switch case 50, which switch case 50 is provided independently of the operation panel box 20 and is electrically connected to the operation panel box 20 via a cord 54 (FIGS. 1 and 2).

Figure 4:
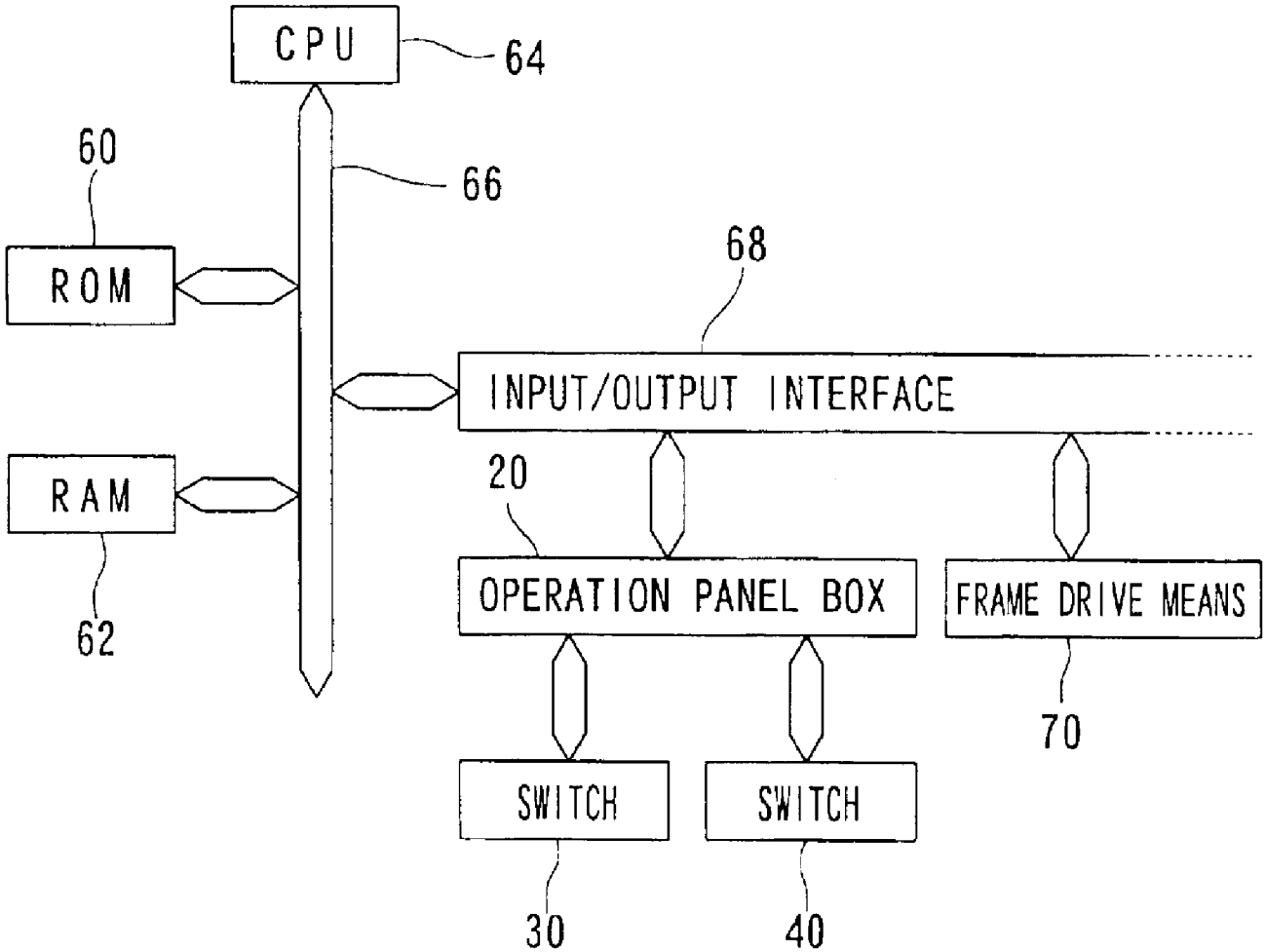
FIG. 4 is a block diagram schematically showing a controller of the embroidery machine including control of movement of an embroidery frame.

FIG. 4 is a block diagram that schematically shows a controller of the embroidery machine 10 including control of movement of the embroidery frame 18. The controller includes a ROM 60, a RAM 62, a CPU 64, a bus 66 and an input/output interface 68. The CPU 64 controls the entire controller according a program that is stored in the ROM 60. The RAM 62 stores various kinds of data that are necessary for the embroidering operation.

When either frame movement command switch 30 or 40 is operated, corresponding signals are inputted as data via the operation panel box 20 and the input/output interface 68, and control signals are outputted to a frame drive means 70.

Of the frame movement command switches 30 and 40, the frame movement command switch 30 that is disposed on the front surface of the operation panel box 20 will be first described. The frame movement command switch 30 is a switch known as a "joy stick type switch" and is operable to incline a single operation portion 34 in a plurality of directions relative to a switch body 32. The operation portion 34 is constituted by securing a rear central portion of a single operation disk 34*a* to a tip end of a single operation rod 34*b* that extends from the inside of the switch body 32. A total of four triangular arrows 35 are provided on the front surface of the operation disk 34*a* and are oriented toward the upward, downward, rightward and leftward directions, respectively, which are indicative of the switch operating directions.

Eight contacts (switches) are disposed within the switch body 32 at 45° intervals around the axis of the operation rod 34*b*. Therefore, the eight contacts may be turned ON and OFF by inclining the operation portion 34 toward a total of eight directions, which includes the four directions indicated by the arrows 35 of the operation disk 34*a* and their intermediate directions. Consequently, the frame drive means 70 may output signals in order to move the embroidery frame in directions corresponding to the respective operating directions of the operation member 34.

Incidentally, the operation member 34 is operable to be pushed into the switch body 32 along the axis of the operation rod 34*b*; further, a ninth switch, which is different from the above-described eight contacts, may be turned ON when the operation member 34 is pushed inward. When this switch is turned ON, the moving speed of the embroidery frame 18 may be changed to a low speed.

For example, a switch distributed by Alps Electric, Co. Ltd. Under the brand name "Multi-direction Switch" (Model No. JXS0000-0301) may be used as the frame movement command switch 30.

As shown in FIG. 3, the switch body 32 of the frame movement command switch 30 is disposed within the operation panel box 20. The operation disk 34*a* is positioned in a recess 26 that is defined within the front surface of the operation panel box 20. The tip end of the operation rod 34*b* extends through the central portion of the recess 26 and is fixed to the operation disk 34*a* as explained above. The surface of the operation disk 34*a* is set to be flush with or slightly recessed from the front surface of the operation panel box 20, so that the operation disk 34*a* may be prevented from being mistakenly operated.

Figure 5:
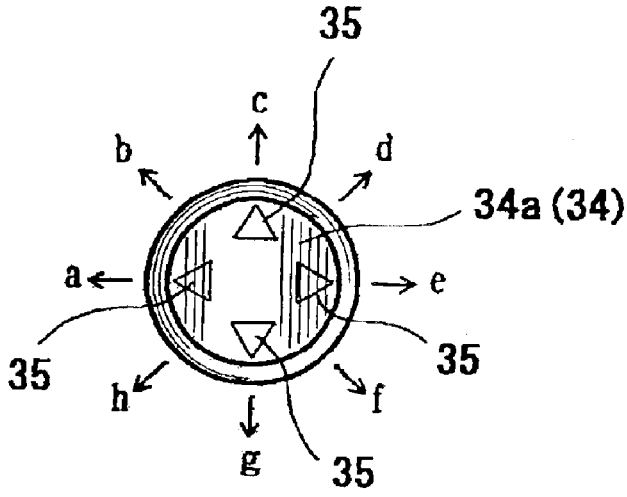
FIG. 5 is an explanatory view showing the operating directions of a frame movement command switch provided on an operation panel box.
Figure 6:
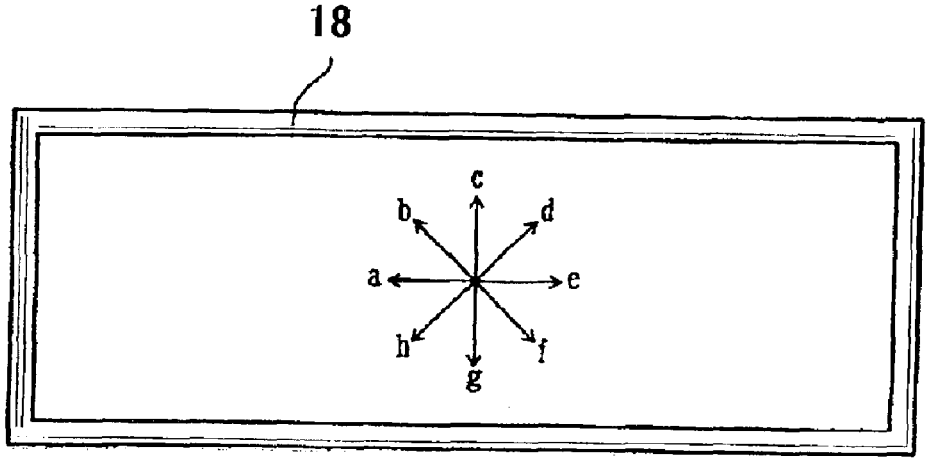
FIG. 6 is an explanatory view showing the moving directions of the embroidery frame caused by operating the switch shown in FIG. 5.

FIG. 5 is an explanatory view showing the operating directions of the operation portion 34 of the frame movement command switch 34; FIG. 6 is an explanatory view showing the moving directions of the embroidery frame 18. As described above, when the switching operation is performed in the directions indicated by arrows a, c, e and g in FIG. 5 by pressing the areas of the respective triangular arrows 35 of the operation disk 34*a*, the embroidery frame 18 may be controlled to move in the directions (X-Y directions) indicated by arrows a, c, e and g shown in FIG. 6 within an X-Y plane. In addition, when the switching operation is performed in the directions indicated by arrows b, d, f and h in FIG. 5 by pressing the intermediate areas of the respective triangular arrows 35 of the operation disk 34*a*, the embroidery frame 18 may be controlled to move in the directions (X-Y composite directions) indicated by arrows b, d, f and h shown in FIG. 6.

The frame movement command switch 40 disposed within the switch case 50 will now be described. The frame movement command switch 40 is different in type from the frame movement command switch 30 and is configured such that a single operation portion 44 can be inclined in any direction relative to a switch body 42 shown in FIG. 2. The operation portion 44 is constructed by fixing a rear central portion of an operation disk 44*a*, which operation disk 44*a* has a surface configuration that can be suitably touched by a ball of a fingertip (e.g., a fingertip of the thumb), to a tip end of a single operation rod 44*b* that extends from within the switch body 42.

Figure 9:
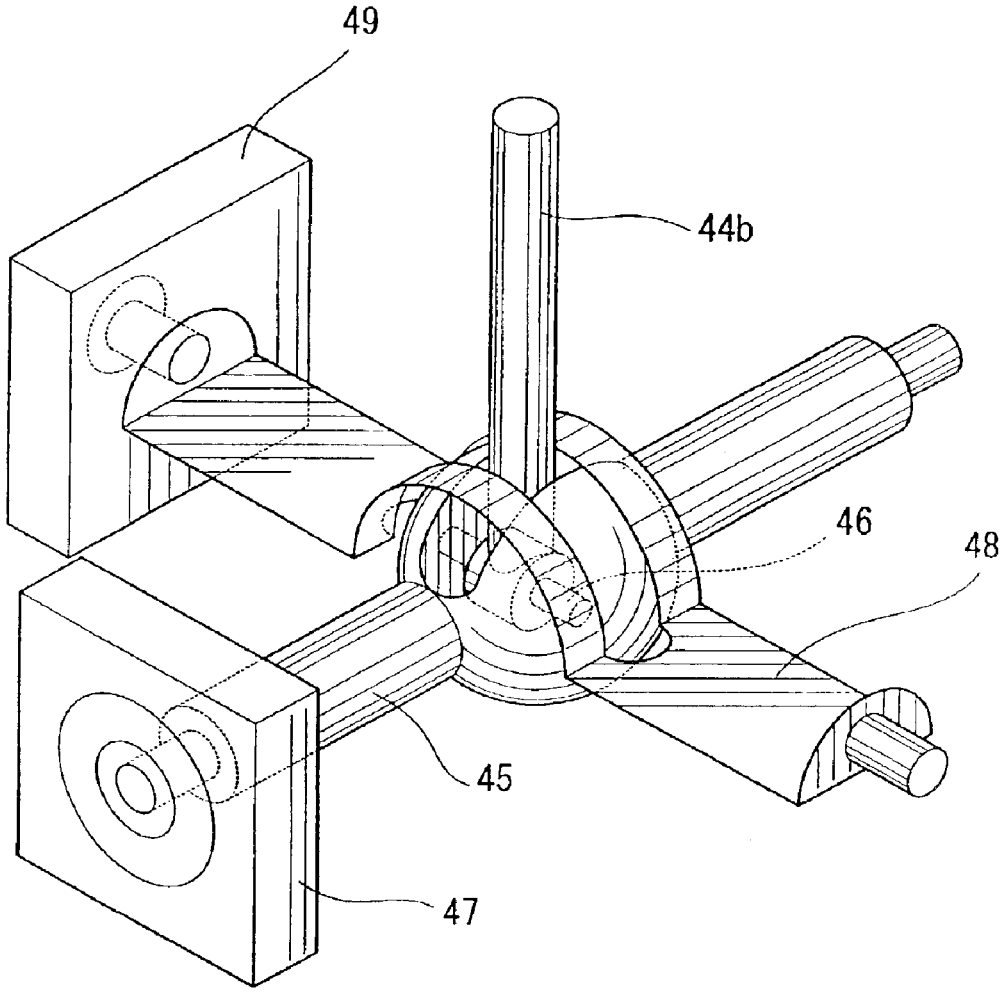
FIG. 9 is a perspective view schematically showing the internal structure of the frame movement command switch disposed in the switch case.
Figure 10:
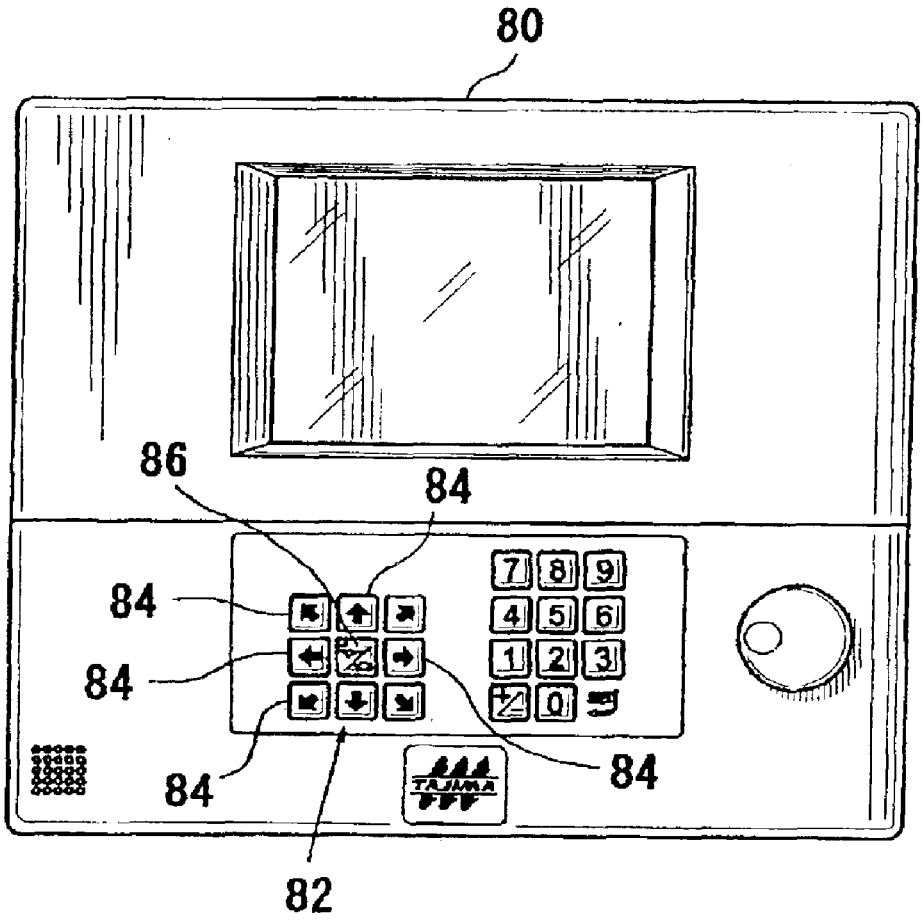
FIG. 10 is a front view of an operation panel box of a known embroidery machine as an example.

FIG. 9 is a perspective view schematically showing the internal structure of the switch body 42. As shown in this figure, the operation rod 44*b* of the operation member 44 is supported on the shaft 46 at the intersection of two shafts 45 and 46 that have intersecting axes. One shaft 45 is supported to freely rotate relative to the switch body 42, and the other shaft 46 is supported to freely rotate relative to the shaft 45. Therefore, the operation rod 44*b* is operable to be inclined in any direction and by any angle. In addition, as the operation rod 44*b* is operated to rotate about the axis of the shaft 46, an associated rotary member 48 rotates about the axis of the shaft 46 in conjunction with the rotation of the shaft 46. The associated rotary member 48 is configured not to interfere with the movement of the operation rod 44*b* when the operation rod 44*b* is operated to rotate about the axis of the shaft 45.

One end of the shaft 45 is connected to the center of rotation of a rotary variable resistor 47, and one end of the associated rotary member 48 is connected to the center of rotation of another rotary variable resistor 49. Each of the variable resistors 47 and 49 receives a predetermined supply of current and may rotate in response to the inclination of the operation rod 44*b* so as to output a voltage that corresponds to the inclination angle.

As shown in FIG. 2, the switch body 42 is disposed within the switch case 50. The operation disk 44*a* is fixed to the tip end of the operation rod 44*b* in a recess 51 that is defined within the upper surface of the switch case 50. The switch case 50 is configured such that a ball of a fingertip can easily touch the operation disk 44*a* when a grip portion 52 of the switch case 50 is held. Therefore, the operation rod 44*b* can be inclined in any direction by moving the operation disk 44*a* in various directions while the ball of the fingertip touches the operation disk 44*a*. Based upon the voltage signal that is outputted from one or both of the variable resistors 47 and 49 in response to the operating direction, the frame drive means 70 outputs signals for moving the embroidery frame 18 in the direction corresponding to the operating direction of the operation rod 44*b*.

Further, the frame movement command switch 40 is configured to utilize the change in output voltage value from the variable resistors 47 and 49 in response to the inclination angle of the operation rod 44*b*, so that the frame drive means 70 will output signals for increasing or decreasing the moving speed of the embroidery frame 18. Thus, the moving speed increases as the inclination angle of the operation rod 44*b* increases. Therefore, the speed change switch 24 of the operation panel box 20 is no longer necessary to be used when the frame movement command switch 40 is used.

For example, products distributed by Alps Electric, Co. Ltd. under the brand name "Stick Controller" (Model No. RKJXK1225) may be used as the frame movement command switch 40.

Figure 7:
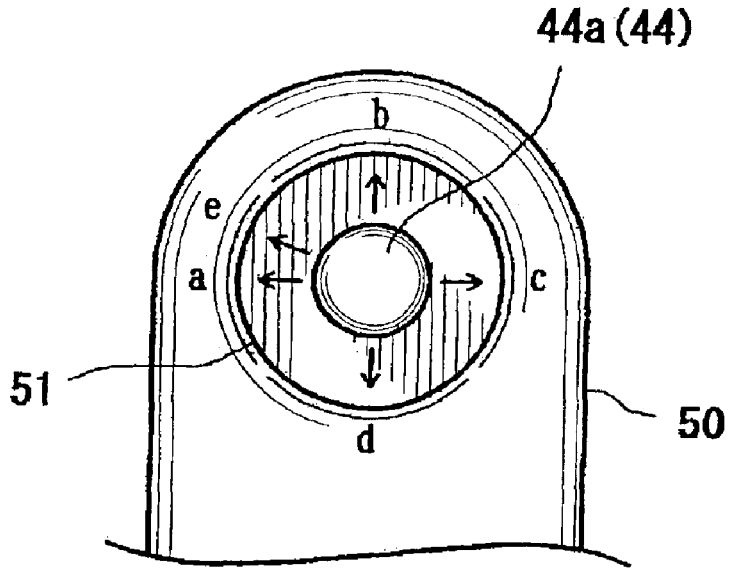
FIG. 7 is an explanatory view showing the operating directions of the frame movement command switch provided in a switch case.
Figure 8:
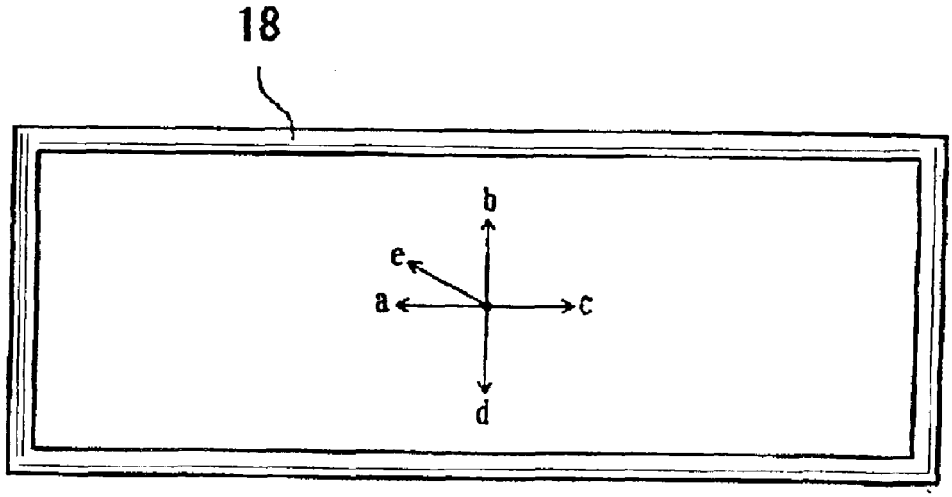
FIG. 8 is an explanatory view showing the moving directions of the embroidery frame caused by operating the switch shown in FIG. 7.

FIG. 7 is an explanatory view showing the operating directions of the operating portion 44 of the frame movement command switch 40; FIG. 8 is an explanatory view showing the moving directions of the embroidery frame 18. In addition to the directions of arrows a, b, c and d shown in FIG. 7, which directions correspond to the X-Y moving directions of the embroidery frame 18, the operation disk 44*a* of the frame movement command switch 40 can be moved in any other direction. For example, when the operation disk 44*a* is operated in the direction of arrow e in FIG. 7, the embroidery frame 18 may be controlled to move in the direction of arrow e in FIG. 8.

In order to control movement of the embroidery frame 18, it is sufficient to use only the frame movement command switch 40 of the switch case 50; the frame movement command switch 30 of the operation panel box 20 may be used as an auxiliary switch. Therefore, the operator can hold the switch case 50 with his/her hand and can operate the switch while he or she is located in a position that is optimal for controlling the movement of the embroidery frame 18; thus, the embroidery frame 18 can be controlled to move in a desired direction at a desired speed.

In addition, by using either frame movement command switch 30 and 40, the switching operation can be accurately performed depending only on the feeling by the fingertip that touches the respective operation disk 34*a* or 44*a* without looking at the operation disks 34*a* or 44*a*. Furthermore, a troublesome operation for selecting and pushing key switches every time that the moving direction of the embroidery frame 18 is changed can be eliminated.

Although a preferred embodiment of the present invention has been described with reference to the drawings, it should be understood that this embodiment can be changed or modified without departing from the spirit of the invention defined in the attached claims.

For example, although different types of switches were respectively used for the frame movement command switches 30 and 40, only one of the switch types can be commonly used for these switches. In addition, the operation portions 34 and 44 of the frame movement command switches 30 and 40, respectively, may be replaced with switches of a rolling operation type, e.g., a track ball type.

With regard to the frame movement command switch 40 of the switch case 50, this switch 40 may be configured as a wireless type switch that utilizes radio waves or light instead of the cord 54. In addition, it may be convenient if the switch case 50 is configured such that the switch case 50 is stored in a suspended state on a lateral surface or a bottom surface of the operation panel box 20.

What is claimed is:

1. A frame movement command device for an embroidery machine, which device can control the movement of an embroidery frame based upon signals that are outputted from a frame drive means when a frame movement command switch means is operated, wherein;

the frame movement command switch means comprises a first frame movement command switch (40) that includes a single operation portion, the single operation portion of the first frame movement command switch is operable to incline in any direction from an original position, the frame drive means outputs signals in order to move the embroidery frame in directions that correspond to the inclined directions of the operation portion, the first frame movement command switch is mounted to a portable switch case, and wherein the first frame movement command switch is connected to an operation panel box of the embroidery machine via any one of a cord, radio waves or light, and wherein the operation panel box is attached to the embroidery machine.

2. A frame movement command device for an embroidery machine as in claim 1, wherein the frame drive means outputs signals for increasing and decreasing the moving speed of the embroidery frame in response to the inclination angle of the operation portion of the first frame movement command switch relative to the original position.

3. A frame movement command device for an embroidery machine as in claim 1, wherein the switch case includes a grip portion and is configured to permit fingertips to easily touch the operation portion of the first frame movement command switch while the operator holds the grip portion.

4. A frame movement command device for an embroidery machine, which device can control the movement of an embroidery frame based upon signals that are outputted from a frame drive means when a frame movement command switch means is operated, wherein;

the frame movement command switch means comprises a first frame movement command switch (40) that includes a single operation portion, the single operation portion of the first frame movement command switch is operable to incline in any direction from an original position, the frame drive means outputs signals in order to move the embroidery frame in directions that correspond to the inclined directions of the operation portion, and the first frame movement command switch is mounted to a portable switch case, wherein the frame movement command switch means further includes a second frame movement command switch mounted to an operation panel box attached to the embroidery machine, so that the frame drive means can output signals to control the movement of the embroidery frame based on the operation of either the first frame movement command switch or the second frame movement command switch.

5. A frame movement command device for an embroidery machine as in claim 4, wherein the second frame movement command switch includes a single operation portion that is operable to incline in a plurality of positions from an original position, so that the frame drive means outputs signals in order to move the embroidery frame in the directions that correspond to the inclined directions of the operation portion.

* * * * *